United States Patent [19]

Kajiwara

[11] 4,177,990

[45] Dec. 11, 1979

[54] RACKET FRAME

[75] Inventor: Takao Kajiwara, Hamamatsu, Japan

[73] Assignee: Nippon Gakki Seizo Kabushiki Kaisha, Japan

[21] Appl. No.: 837,541

[22] Filed: Sep. 28, 1977

[30] Foreign Application Priority Data

Oct. 4, 1976 [JP] Japan ..... 51/119226

[51] Int. Cl.[2] ..... A63B 49/10

[52] U.S. Cl. ..... 273/73 C; 273/73 F; 264/45.1

[58] Field of Search ..... 273/67 R, 72 A, 73 R, 273/73 C, 73 F, 73 H, 80 R, 80 B, DIG. 8

[56] References Cited

U.S. PATENT DOCUMENTS

| | | | |
|---|---|---|---|
| 1,588,139 | 6/1926 | Penny | 273/73 H |
| 3,265,401 | 8/1966 | Spier | 273/80 B X |
| 3,727,295 | 4/1973 | Gildemeister | 273/72 A X |
| 3,771,805 | 11/1973 | Ishida | 273/73 F X |
| 3,814,423 | 6/1974 | Shockley et al. | 273/73 C |
| 3,949,988 | 4/1976 | Staufer | 273/73 F |
| 3,993,308 | 11/1976 | Jenks | 273/73 F |
| 4,061,520 | 12/1977 | Cecka et al. | 273/73 F X |

FOREIGN PATENT DOCUMENTS

| | | | |
|---|---|---|---|
| 2106800 | 9/1971 | Fed. Rep. of Germany | 273/73 C |
| 1059989 | 11/1953 | France | 273/73 D |
| 1582080 | 8/1969 | France | 273/73 D |
| 381673 | 10/1932 | United Kingdom | 273/73 H |
| 1126438 | 9/1968 | United Kingdom | 273/73 C |
| 1434741 | 5/1976 | United Kingdom | 273/73 F |

*Primary Examiner*—Richard J. Apley

*Attorney, Agent, or Firm*—Ostrolenk, Faber, Gerb & Soffen

[57] ABSTRACT

A fiber reinforced racket frame advantageously usable for tennis rackets includes a discontinuous foamed resin core made up of a plurality of core pieces longitudinally aligned in end-to-end relationship which preferably vary in the transverse cross-sectional characteristic and/or density from piece to piece. Longitudinal discontinuity and, preferably, change in at least one of the transverse cross-sectional characteristics and density effectively hinder direct and smooth transmission to players' hands of the impact imposed on the playing face of the racket. The manufacturing process is greatly simplified so as to fit automatization and mass-production.

14 Claims, 13 Drawing Figures

RACKET FRAME

BACKGROUND OF THE INVENTION

The present invention relates to an improved racket frame and a method for manufacturing same, and more particularly relates to improvement in the foamed resin core construction of a fiber reinforced plastic racket frame made by molding process and advantageously usable for tennis rackets.

In the conventional method for manufacturing a fiber reinforced racket frame, an elongated foamed resin core of a longitudinally continuous construction is wholly wrapped and covered by a fiber reinforced plastic envelope which contains numerous reinforcing fibers preimpregnated with thermosetting resin. The foamed resin core functions as a member for damping elastic vibratory waves generated by impact imposed on the playing face of the racket at striking balls and the fiber reinforced envelope functions as a member for bearing the impulsive stresses working on the racket at striking balls.

Thus, in the conventional racket frame, the foamed resin core is quite continuous over the entire length thereof and the transverse cross-sectional characteristics and the density are both substantially over the entire length thereof. From the viewpoint of vibration system, the above-described continuous construction and mechanical uniformity of the conventional racket frame are well suited for smooth transmission of elastic vibratory waves.

Therefore, with the above-described core construction in the conventional racket frame, vibrations generated by impact imposed on the strings at striking balls are transmitted quite directly and smoothly to players' hand via the throat and shaft portions of the racket frame and give the players "hard touch" at striking balls and the so-called "tennis elbow" troubles. In addition, the uniformity in the transverse cross-sectional characteristics and density results in uniform distribution of weight in various portions of the racket frame. This uniform weight distribution causes difficulty in delicate control in swinging the racket at striking balls.

In order to obviate these disadvantages, it is proposed to change the geometrical moment of inertia from portion to portion along the length of the racket frame. This can be attained by changing the transverse cross-sectional characteristics, such as the transverse cross sectional surface area and profile, from portion to portion of the racket frame. This change in the geometrical moment of inertia may successfully hinder smooth transmission of the elastic vibratory waves.

In practical production, the above-described foamed resin cores are formed by cutting a longer material rod into several blocks of a prescribed length and, for advantage in productivity, the elongated material rod is formed by continuous extrusion of the material resin. With this extrusion system, it is almost impossible in practice to provide the extruded material rod with periodical local change in the transverse cross-sectional characteristics, i.e. the geometrical moment of inertia. So, in order to change the transverse cross-sectional characteristics from portion to portion of a racket frame, it is necessary to apply mechanical surface cutting to individual cores after cutting from the extruded longer material rod. Such individual handling system is clearly unsuited for process automatization and mass-production, which, as well known, assure high productivity with reduced labour and, therefore, advantage in economy.

SUMMARY OF THE INVENTION

It is the primary object of the present invention to provide a racket frame advantageously usable for tennis rackets which is capable of effectively hindering direct and smooth transmission of impact at striking balls to players' hands, thereby assuring soft touch and mitigating physical damage on players' hands.

It is another object of the present invention to provide a racket frame advantageously usable for tennis rackets which has optimumly adjusted weight distribution assuring delicate control in swinging the racket at striking balls.

It is the other object of the present invention to provide a remarkably simplified method for manufacturing a fiber reinforced racket frame advantageously usable for tennis rackets which is well suited for automatization and mass production with high productivity and lowered cost.

In accordance with the present invention, the foamed resin core of the racket frame is provided with a longitudinally discontinuous construction which is made up of a plurality of foamed resin core pieces longitudinally aligned in end-to-end relationship. In the manufacturing, a plurality of foamed resin core pieces are longitudinally aligned in end-to-end relationship to form an elongated discontinuous foamed resin core which is then wholly wrapped and covered with a fiber reinforced plastic envelope. The elongated material rod is curved and then subjected to heat molding under pressure.

DESCRIPTION OF THE PREFERRED EMBODIMENTS

Figure 1:
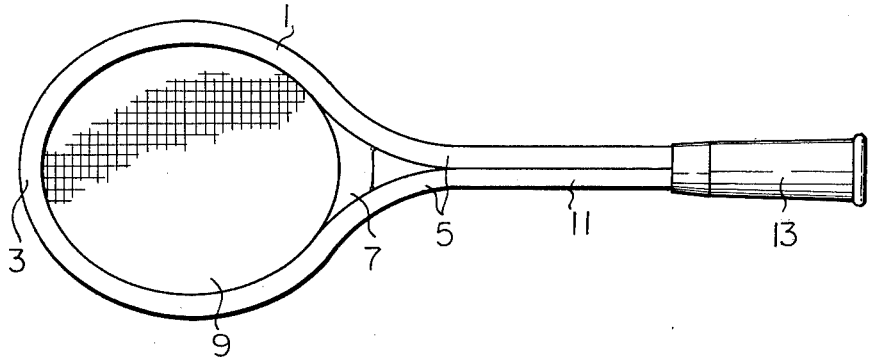
FIG. 1 is a top view of a popular type tennis racket to which the present invention is applicable.
Figure 2:
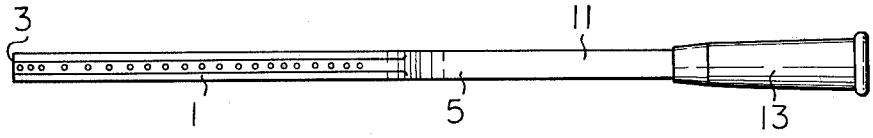
FIG. 2 is a side view of the tennis racket shown in FIG. 1.

FIGS. 1 and 2 generally depict a tennis racket of popular type and construction of a fiber reinforced plastics to which the present invention is applicable.

The racket comprises a frame 1 having an approximately oval-shaped or ovaloid head portion terminating in a pair of closely spaced sloping extensions forming a throat portion 5 of the racket. A separate throat piece or yoke 7 is disposed to the inner sides of the sloping frame extensions at the throat portion 5. The oval-shaped portion of the frame 1 and the yoke 7 defines a striking area or playing face 9 of the racket which is comprised of main or long strings and cross or short strings, both being in stretched state. The sloping extensions are coupled side by side with each other to form a handle or shaft portion 11 of the racket, the end of which is encased by a grip portion 13.

Figure 3:
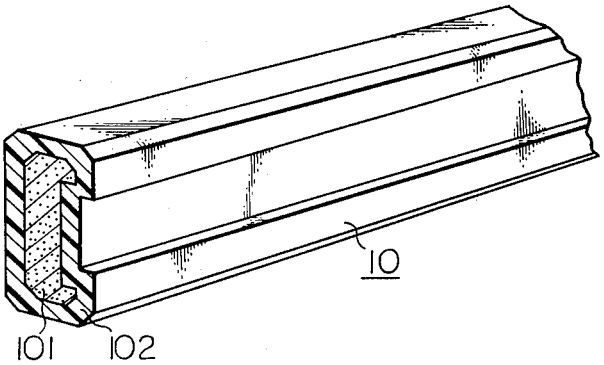
Fig. 3 PRIOR ART
FIG. 3 is a fragmentary perspective view, partly in section, of a foamed resin core used for the conventional racket frame.

The racket frame 1 is made of fiber reinforced plastics in general by molding process. For molding, an elongated continuous straight rod 10 such as shown in FIG. 3 is conventionally used, which is comprised of a core 101 generally made of a foamed resin such as urethane foam. This foamed resin core 101 is wholly covered by an envelope 102 made of numerous fibers impregnated with thermosetting resin. Usually, fibers such as graphite fibers, glass fibers, boron fibers and/or carbon fibers are used for reinforcement.

Figure 4:
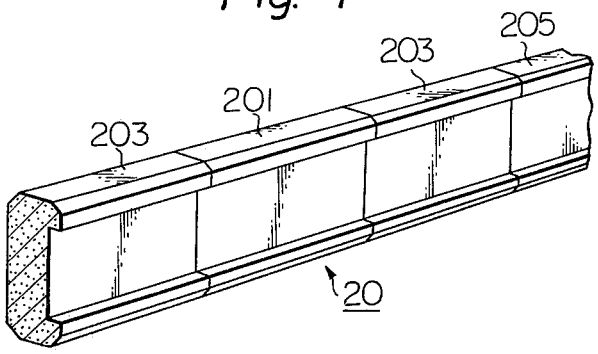
FIG. 4 is a fragmentary perspective view, partly in section, of a longitudinally discontinuous foamed resin core used for the tennis racket in accordance with the present invention.

One embodiment of the foamed resin core in accordance with the present invention is shown in FIG. 4, in which the core 20 is provided with a longitudinally discontinuous construction. That is, the core 20 is made up of a plurality of core pieces 201, 203 and so on. The core pieces 201,203 and so on are different from each other in their transverse cross-sectional surface areas, transverse cross-sectional profiles, lengths and/or densities.

Figure 5:
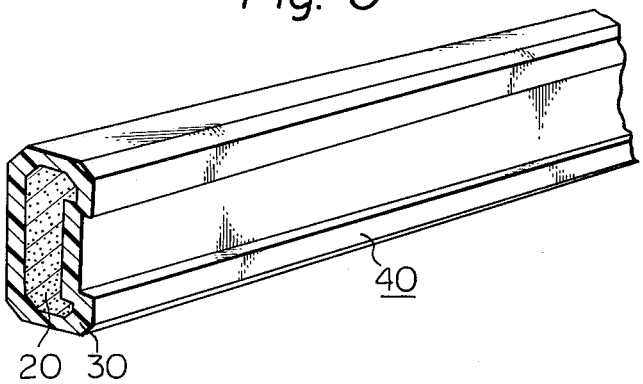
FIG. 5 is a fragmentary perspective view, partly in section, of the racket frame in accordance with the present invention.
Figure 6:
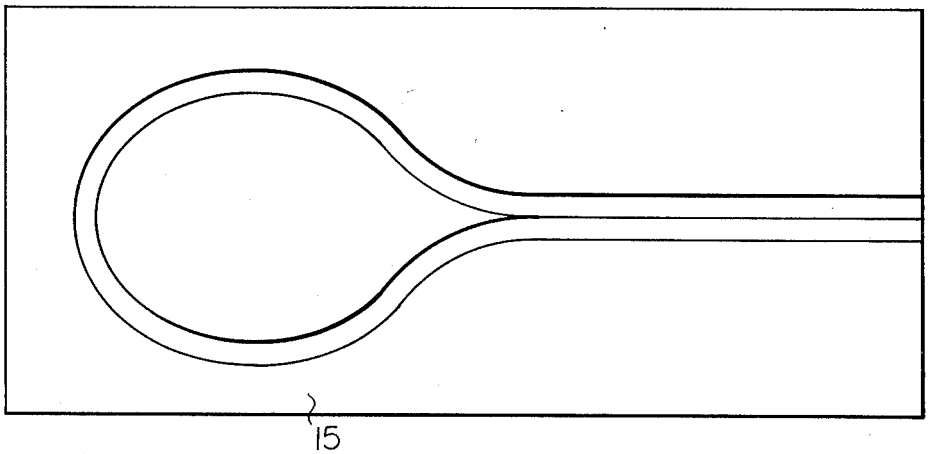
FIG. 6 is a top view of a mold used for shaping the racket frame in accordance with the present invention.

In the manufacturing of the racket frame 1, the core 20 of the above-described discontinuous construction is wholly wrapped and covered by a prepreg envelope 30 made of numerous reinforcing fibers preinpregnated with thermosetting resin to form a straight material rod 40 as shown in FIG. 5, in which the core pieces 201, 203 and so on are arranged in end-to-end relationship. This straight material rod 40 is curved and placed in position between cooperating mold 15, one of which is shown in FIG. 6, and hardened into the end product by application of heat under pressure.

Figure 7:
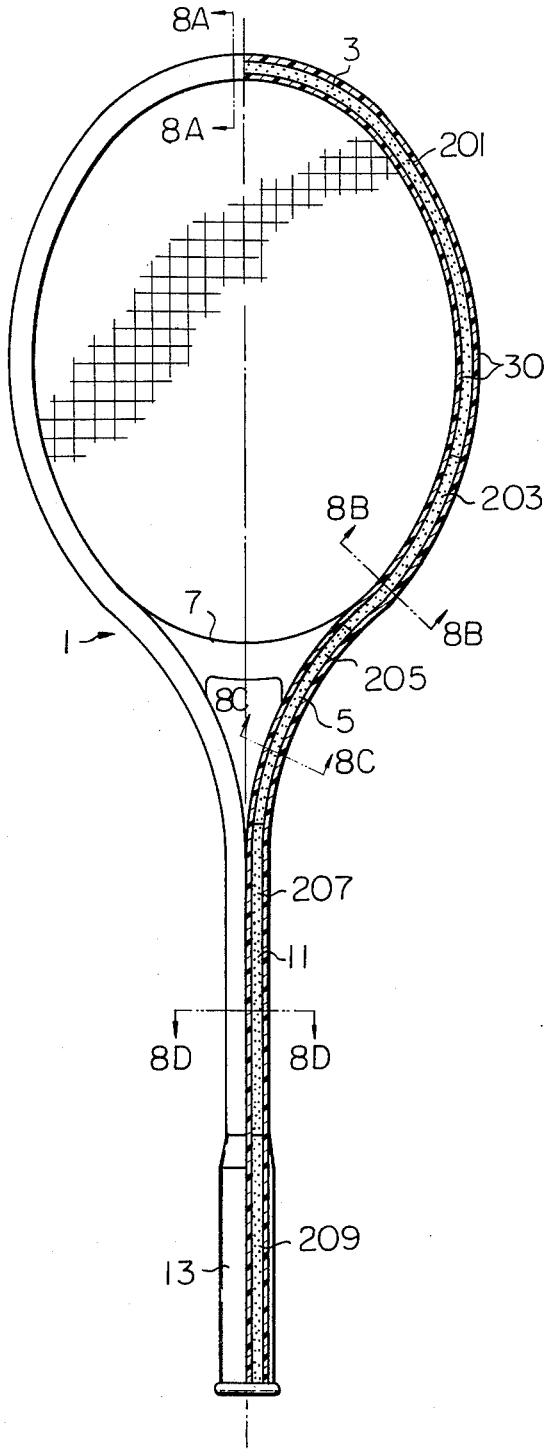
FIG. 7 is a top view, partly in section, of an example of the tennis racket manufactured in accordance with the present invention.

One example of the tennis racket in accordance with the present invention is shown in FIG. 7, in which the core piece 201 is used for the head portion 3, the core piece 205 is used for the throat portion, the core piece 203 is used for the intermediate portion connecting the head portion 3 to the throat portion 5, the core piece 207 is used for the shaft portion 11 and the core piece 209 is used for the grip portion 13.

As already described, the respective core pieces 201,203 and so on are different from each other in their transverse cross-sectional dispositions, lengths and/or densities. Examples of the transverse cross-sectional dispositions taken at various portions along the racket frame 1 are shown in FIGS. 8A through 8D.

Figure 8A:
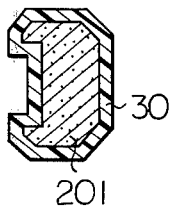
FIGS. 8A through 8D are transverse cross sections taken along lines 8A—8A, 8B—8B, 8C—8C and 8D—8D in FIG. 7, respectively.

The cross section shown in FIG. 8A is taken in the head portion 3 and the core piece 201 is used therefor. The core piece 201 used for the portion 3 is rather narrow in width and thin in thickness in order to reduce the weight of the head portion 3.

Figure 8B:
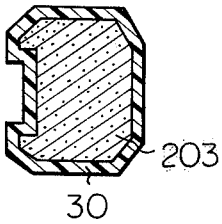

The cross section shown in FIG. 8B is taken in the intermediate portion and the core piece 203 is used therefor. The core piece 203 used for the portion is rather broad in width and thick in thickness in order to enrich the bending stiffness of the intermediate portion.

Figure 8C:
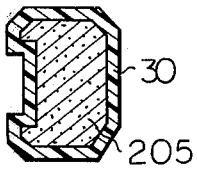

The cross section shown in FIG. 8C is taken in the throat portion 5 and broad in width and thin in thickness in order to provide the flexibility of the racket frame.

Figure 8D:
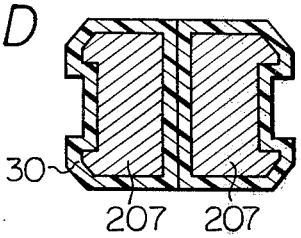

The cross section shown in FIG. 8D is taken in the shaft portion 11 and the core piece 207 is used therefor. The thickness of the core piece 207 used for this portion 11 is increased gradually towards the grip portion 13 in order to gradually increase the bending stiffness thereof.

As is clear from the illustration, the cross sections are provided with corner cut-outs whose dimension varies from piece to piece in order to delicately adjust the reactive characteristics of the racket frame 1.

In the case of the above-described embodiment, the core 20 is divided into a number of longitudinally aligned core pieces 201, 203 and so on over the entire length of the racket frame 1. However, sufficient result can be obtained when the core 20 is divided in the throat portion 5 only.

Figure 9A:
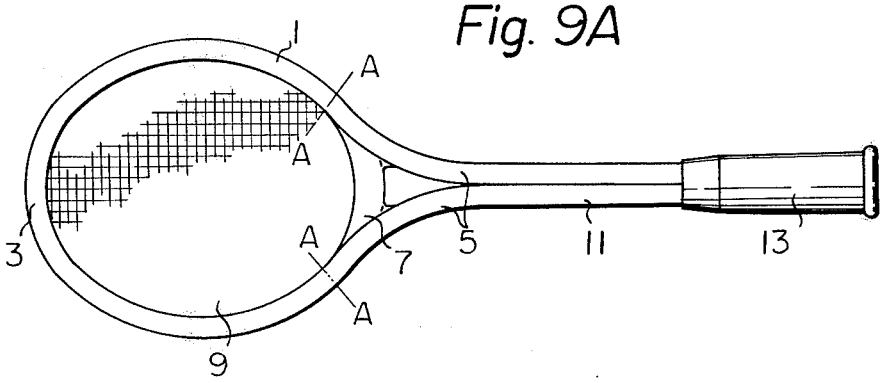
FIGS. 9A and 9B are explanatory top views of other examples of the tennis racket manufactured in accordance with the present invention.

One example of the practical tennis racket is shown in FIG. 9A, in which the racket frame 1 comprises a core divided in the throat portion 5 along lines A—A. Thus, the core is made of three core pieces, one extending majorly in the head and intermediate portions and the other two extending in the throat, shaft and grip portions. In this case, the transverse cross-sectional profile changes from the grip to the head portion.

Figure 9B:
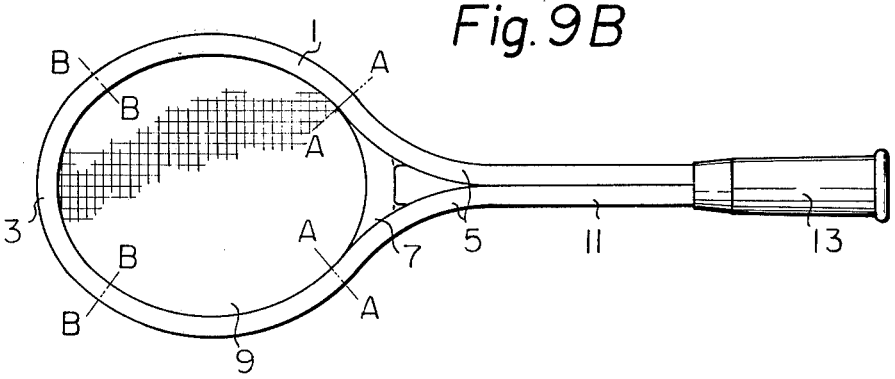

The other example of the practical tennis racket is shown in FIG. 9B, in which the racket frame 1 comprises a core divided in the throat and head portions along lines A—A and B—B. Thus, the core is made of five core pieces, one extending in the head portion, the other two extending majorly in the intermediate portions and the last two extending in the throat, shaft and grip portions. This construction is well suited for control of the stiffness characteristics of the head portion.

As is clear from the foregoing description, the tennis racket in accordance with the present invention comprises a foamed resin core of a longitudinally discontinuous construction, i.e. the foamed resin core is made of a plurality of core pieces longitudinally aligned in end-to-end relationship. Further, these core pieces may be made different from each other in their lengths, transverse cross-sectional profiles, transverse cross sectional surface areas and/or densities.

The longitudinal discontinuity of the core construction effectively hinders direct and smooth transmission of the elastic vibratory waves caused by impact on the playing face at striking of the ball. That is, reflection deflection and diffusion of the elastic vibratory waves take place at mating end borders between neighbouring core pieces. Thus, the impact on the players' hands can well be damped to prevent or at least reduce damages on the players' hands. This hinderance of the elastic vibratory waves trnasmission can further be assisted by change in the transverse cross-sectional characteristics and/or change in the densities from piece to piece of the discontinuous core.

Further, by skillfully adjusting the change in the transverse cross-sectional characteristics and/or densities from piece to piece of the discontinuous core, it is possible to optimally and delicately control distributions of weight and bending stiffness along the length of the racket frame.

In practical production of the racket frame in accordance with the present invention, each of the core piece are given in the form of an elongated rod having uniform transverse cross-sectional characteristics and density. This rod can easily be manufactured by molding process. Next, the rod is cut into pieces of a described uniform length. This molding and cutting process is well suited for automatization. After cut pieces are prepared for core pieces of different types (lots), core pieces of different constructions are assembled by one from each lot and subjected for covering by the above-described fiber reinforced plastic envelope. This process can be automatized also when desired. Thus, the manufacturing process of the present invention is excellently suited for automatization of the process, thereby remarkably saving lobour and cost.

I claim:

1. An improved racket frame comprising a discontinuous core extending continuously around said racket frame and made up of a plurality of foamed resin core pieces longitudinally aligned in end-to-end abutting relationship, and a fiber reinforced plastic envelope, with numerous fibers embedded therein, wholly covering said discontinuous core.

2. The improved racket frame as claimed in claim 1 in which the transverse cross-sectional characteristics of said discontinuous core change from one said piece to the abutting said piece.

3. The improved racket frame as claimed in claim 2 in which the transverse cross-sectional surface area of said discontinuous core changes from one said piece to the abutting said piece.

4. The improved racket frame as claimed in claim 2 in which the transverse cross-sectional profile of said discontinuous core changes from one said piece to the abutting said piece.

5. The improved racket frame as claimed in claim 2 in which said racket frame has a head portion and other portions away from said head portion, at least one said core piece in said head portion, said core piece in said head portion of said racket frame being relatively narrower in the width dimension of said racket frame and relatively thinner in the thickness dimension of said racket frame than the said core pieces in the portions of said racket frame other than said head portion.

6. The improved racket frame as claimed in claim 2 in which said racket frame has a head portion, a support shaft portion and intermediate portions between said head portion and said shaft portion, at least one said core piece in said head portion and at least another said core piece in said intermediate portions, said core pieces in said intermediate portions of said racket frame being relatively broader in the width dimension of said racket frame and relatively thicker in the thickness dimension of said racket frame than the said core piece in said head portion of said racket frame.

7. The improved racket frame as claimed in claim 2 in which said racket frame has a head portion and has a throat portion away from said head portion, at least one said core piece in said head portion, at least another said core piece in said throat portion, said core pieces in said throat portion of said racket frame being relatively broader in the thickness dimension of said racket frame for providing flexibility to said racket frame.

8. The improved racket frame as claimed in claim 2 in which said racket frame has a head portion and has a shaft portion away from said head portion, a grip portion at the end of said shaft portion away from said head portion, at least one said core piece being in said head portion, at least one said core piece being in said shaft portion, said core pieces in said shaft portion of said tennis racket gradually increase in their thickness dimension towards said grip portion of said tennis racket.

9. The improved racket frame as claimed in claim 1 in which the density of the resin of said discontinuous core changes from said piece to said piece.

10. The improved racket frame as claimed in claim 1 in which said racket frame includes a head portion, a throat portion, an intermediate portion between said head portion and said throat portion and a shaft portion extending away from said throat portion; said core pieces being shaped and placed so that there are abutting end portions of said core pieces located at least in said throat portion of said racket frame.

11. The improved racket frame as claimed in claim 10 in which said racket frame further includes a grip portion at said shaft portion, said discontinuous core comprises three said core pieces, one said core piece extending majorly in said head and intermediate portions and the other two said core pieces extending majorly in said throat, shaft and grip portions of said racket frame, respectively.

12. The improved racket frame as claimed in claim 10 in which said racket frame further includes a grip portion at said shaft portion, said discontinuous core comprises five said core pieces, one said core piece extending in said head portion, two other said core pieces extending majorly in said intermediate portions of said frame and the last two said core pieces extending majorly in said throat, shaft and grip portions of said racket frame, respectively.

13. The improved racket frame as claimed in claim 1 in which said discontinuous core is made of urethane foam.

14. The improved racket frame as claimed in claim 1 in which said fiber reinforced plastic envelope contains fibers of at least one selected from the group consisting of glass fibers, boron fibers, graphite fibers and carbon fibers and said envelope is impregnated by thermosetting resin.

* * * * *